US008841053B2

(12) United States Patent
Zhou et al.

(10) Patent No.: US 8,841,053 B2
(45) Date of Patent: Sep. 23, 2014

(54) ORGANIC PHOTOCONDUCTORS WITH LATEX POLYMER OVERCOAT LAYERS

(75) Inventors: Zhang-Lin Zhou, Palo Alto, CA (US); Krzysztof Nauka, Palo Alto, CA (US); Lihua Zhao, Sunnyvale, CA (US); Hou T. Ng, Campbell, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 148 days.

(21) Appl. No.: 13/552,940

(22) Filed: Jul. 19, 2012

(65) Prior Publication Data

US 2014/0023963 A1 Jan. 23, 2014

(51) Int. Cl.
*G03G 5/00* (2006.01)
*G03G 5/147* (2006.01)

(52) U.S. Cl.
CPC ..... *G03G 5/14708* (2013.01); *G03G 5/14734* (2013.01)
USPC ..... 430/66; 430/130

(58) Field of Classification Search
CPC ..... G03G 5/14734; G03G 5/14708
USPC ..... 430/66, 130
See application file for complete search history.

(56) References Cited

U.S. PATENT DOCUMENTS

| | | | | |
|---|---|---|---|---|
| 4,990,418 | A | 2/1991 | Mukoh et al. | |
| 5,476,604 | A | 12/1995 | Nguyen et al. | |
| 5,882,814 | A | 3/1999 | Fuller et al. | |
| 6,068,957 | A * | 5/2000 | Nair et al. | 430/66 |
| 6,326,111 | B1 | 12/2001 | Chambers et al. | |
| 6,830,858 | B2 | 12/2004 | Sugino et al. | |
| 6,902,857 | B2 | 6/2005 | Yagi et al. | |
| 7,115,346 | B2 | 10/2006 | Yokota et al. | |
| 7,122,283 | B2 | 10/2006 | Qi et al. | |
| 7,132,208 | B2 | 11/2006 | Lee et al. | |
| 7,361,438 | B2 | 4/2008 | Suzuki et al. | |
| 7,413,835 | B2 | 8/2008 | Lin et al. | |
| 7,645,555 | B2 | 1/2010 | Lin et al. | |
| 7,691,931 | B2 | 4/2010 | Li et al. | |
| 7,709,168 | B2 | 5/2010 | Wu et al. | |
| 2005/0238989 | A1 | 10/2005 | Kakui et al. | |
| 2005/0287452 | A1 | 12/2005 | Tamura et al. | |
| 2005/0287465 | A1 | 12/2005 | Ohshima et al. | |
| 2006/0286473 | A1 | 12/2006 | Kami | |
| 2007/0042281 | A1 | 2/2007 | Orito et al. | |
| 2007/0117033 | A1 | 5/2007 | Sugino et al. | |
| 2009/0035672 | A1 | 2/2009 | Yanagawa et al. | |
| 2009/0047588 | A1 | 2/2009 | Yanus et al. | |

(Continued)

FOREIGN PATENT DOCUMENTS

| | | |
|---|---|---|
| EP | 2028549 | 2/2009 |
| JP | H08262779 | 10/1996 |

(Continued)

*Primary Examiner* — Mark A Chapman
(74) *Attorney, Agent, or Firm* — David W. Collins

(57) ABSTRACT

An organic photoconductor includes: a conductive substrate; a charge generation layer on the conductive substrate; and a charge transport layer on the charge generation layer. An overcoat layer is formed on the charge transport layer. The overcoat layer is a latex polymer in which a charge transport material is dispersed.

20 Claims, 2 Drawing Sheets

(56) References Cited

U.S. PATENT DOCUMENTS

| | | | |
|---|---|---|---|
| 2009/0053637 | A1 | 2/2009 | Lin et al. |
| 2009/0092914 | A1 | 4/2009 | Wu et al. |
| 2009/0148182 | A1 | 6/2009 | Watanabe et al. |
| 2010/0167193 | A1 | 7/2010 | Nukada et al. |
| 2010/0215405 | A1 | 8/2010 | Patton et al. |
| 2010/0260513 | A1 | 10/2010 | Kawasaki et al. |
| 2010/0297543 | A1 | 11/2010 | Tong et al. |
| 2011/0039197 | A1 | 2/2011 | Fujita et al. |
| 2012/0003008 | A1 | 1/2012 | Nauka et al. |
| 2013/0288171 | A1 | 10/2013 | Ganapathiappan et al. |

FOREIGN PATENT DOCUMENTS

| | | |
|---|---|---|
| JP | 9006035 | 1/1997 |
| JP | 09034151 | 2/1997 |
| JP | 2002-311612 | 10/2002 |
| WO | WO-2010104513 | 9/2010 |
| WO | WO-2012115650 | 8/2012 |
| WO | WO-2013147864 | 10/2013 |

* cited by examiner

ORGANIC PHOTOCONDUCTORS WITH LATEX POLYMER OVERCOAT LAYERS

BACKGROUND

An organic photoconductor (OPC) is one of the components in an electrophotographic (EP) printer. A latent image, which is a surface charge pattern, is created on the OPC prior to contact with a development system containing charged marking particles. This is accomplished by uniformly charging the OPC surface, followed by selective illumination that locally generates opposite charges which then move to the surface and locally neutralize deposited charges. The OPC frequently has two layers: an inner layer for generating charges (charge generation layer—CGL) and an outer layer containing molecular moieties for facilitating charge movement (charge transport layer—CTL). The OPC element may have a very uniform and defect free structural and electrical characteristics. Its usable lifetime is often determined by the occurrence of physical defects introduced by mechanical, physicochemical and electrical interactions between the surface of the CTL and one or more elements of the electrophotographic process (commonly known as "OPC wear-out"). Some of the proposed solutions addressing this issue involve coating the CTL surface with a hard, inorganic film that may significantly raise the OPC cost and introduce other deleterious effects associated with the contamination particles originating from the inorganic coating.

Alternative solutions have proposed coating the OPC with an organic coating having superior damage resistance and electrical properties corresponding to the original OPC. This might be accomplished by using a mixture of damage-resistant polymer (matrix) and molecular moieties (CTM—charge transport material) providing electrical charge conduction, and coating the original OPC with their solvent-based mixture.

DETAILED DESCRIPTION

Figure 1:
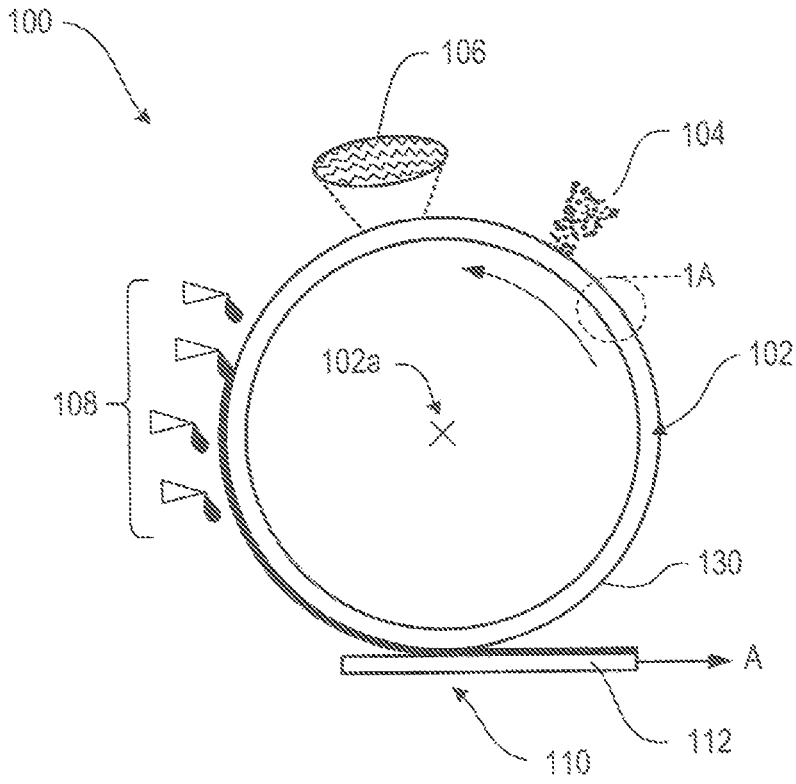
FIG. 1 is a schematic diagram of an apparatus that employs an example organic photoconductor (OPC) drum, in accordance with the teachings herein.

Reference is made now in detail to specific examples, which illustrates the best mode presently contemplated by the inventors for practicing the invention. Alternative examples are also briefly described as applicable.

It is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited only by the appended claims and equivalents thereof.

It is noted that, as used in this specification and the appended claims, the singular forms "a," "an," and "the" include plural referents unless the context clearly dictates otherwise.

As used herein, "about" means a ±10% variance caused by, for example, variations in manufacturing processes.

As used herein, "alkyl" refers to a branched, unbranched, or cyclic saturated hydrocarbon group, which typically, although not necessarily, includes from 1 to 50 carbon atoms, or 1 to 30 carbon atoms, or 1 to 6 carbons, for example. Alkyls include, but are not limited to, methyl, ethyl, n-propyl, isopropyl, n-butyl, isobutyl, t-butyl, octyl, and decyl, for example, as well as cycloalkyl groups such as cyclopentyl, and cyclohexyl, for example.

As used herein, "aryl" refers to a group including a single aromatic ring or multiple aromatic rings that are fused together, directly linked, or indirectly linked (such that the different aromatic rings are bound to a common group such as a methylene or ethylene moiety). Aryl groups described herein may include, but are not limited to, from 5 to about 50 carbon atoms, or 5 to about 40 carbon atoms, or 5 to 30 carbon atoms or more. Aryl groups include, for example, phenyl, naphthyl, anthryl, phenanthryl, biphenyl, diphenylether, diphenylamine, and benzophenone. The term "substituted aryl" refers to an aryl group comprising one or more substituent groups. The term "heteroaryl" refers to an aryl group in which at least one carbon atom is replaced with a heteroatom. If not otherwise indicated, the term "aryl" includes unsubstituted aryl, substituted aryl, and heteroaryl.

As used herein, "substituted" means that a hydrogen atom of a compound or moiety is replaced by another atom such as a carbon atom or a heteroatom, which is part of a group referred to as a substituent. Substituents include, but are not limited to, for example, alkyl, alkoxy, aryl, aryloxy, alkenyl, alkenoxy, alkynyl, alkynoxy, thioalkyl, thioalkenyl, thioalkynyl, and thioaryl.

The terms "halo" and "halogen" refer to a fluoro, chloro, bromo, or iodo substituent.

As used herein, "alcohol" means a lower alkyl chain alcohol, such as methanol, ethanol, n-propanol, iso-propanol, n-butanol, iso-butanol, tert-butanol, pentanol, hexanol, and their analogs.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

The organic photoreceptor (OPC) in an electrophotographic printer is a thin film photoconductive layer. An electrostatic latent image is formed on the pre-charged photoreceptor surface via image-wise optical exposure. A visual image is obtained after the electrostatic image is developed with charged color toner particles that are subsequently transferred to paper and the corona charged with ions to get ready for the next imaging process.

In the electrophotographic process, the photoreceptor (web or cylinder) is required to have very uniform area characteristics: coating uniformity, dark conductivity, and photoconductivity. During each imaging cycle, the OPC surface is subjected to a number of punishing electrochemical and mechanical processes. They include corrosive ozone and acid treatments from corona charging, abrasive mechanical treatments from toner development, and toner transfer to paper and doctor blade cleaning. They may cause removal of the top part of CTL or mechanical damage (scratching) and local cracking of the CTL. In the case of liquid electrophotography (such as used in HP Indigo presses), these processes can be further enhanced by interactions between the solvent (usually a non-polar, ISOPAR®-based mixture) and the polymer constituting the CTL layer. There may be interactions with the intermediate transfer medium, in the case of LEP printing process. Also, the CTL may be subjected to abrasive polishing (from a polishing unit) with a polishing cloth, again in the LEP technology. Damage to the CTL can degrade print quality. Frequent photoconductor replacement has a deleterious impact on the cost of the printing process, which is particularly important for high speed/large volume printing applications (as in the case of HP Indigo digital presses).

An example of an electrophotographic (EP) printer that may employ an organic photoconductor (OPC) is depicted in FIG. 1, which is a schematic diagram of portion of a generic EP printer. An EP printer 100 comprises an OPC drum 102 that is rotatable about an axis 102*a*. The construction of the OPC drum 102, which incorporates the teachings herein, is described in greater detail below.

As the OPC drum 102 rotates, it passes through several stations, including a charging station 104, an exposure station 106, a development station 108, and a transfer station 110.

At the charging station 104, an electrostatic charge is uniformly distributed over the surface of the OPC drum 102. Charging is typically done by a corona or a charge roller.

At the exposure station 106, also known as the image-forming station, the document to be printed or its image formed on a screen is illuminated and either passed over a lens or is scanned by a moving light and lens, such that its image is projected onto and synchronized with the moving drum surface. Where there is text or image on the document, the corresponding area of the drum becomes lit. Where there is no image, the drum is not illuminated. The charge that remains on the drum after this exposure is a "latent" image and is a negative of the original document.

At the development station 108, the drum 102 is presented with toner, e.g., liquid toner, more specifically, black ink in the case of a black ink-only printer and colored inks in the case of a color ink printer. The liquid toner is electrically charged and attracted to areas on the drum bearing complementary electrical charges.

At the transfer station 110, the ink on the drum 102 is transferred to a print medium 112 either directly or through an intermediate transfer medium, moving in the direction indicated by arrow A.

Following ink transfer, the drum 102 is prepared for a new imaging cycle.

Figure 1A:
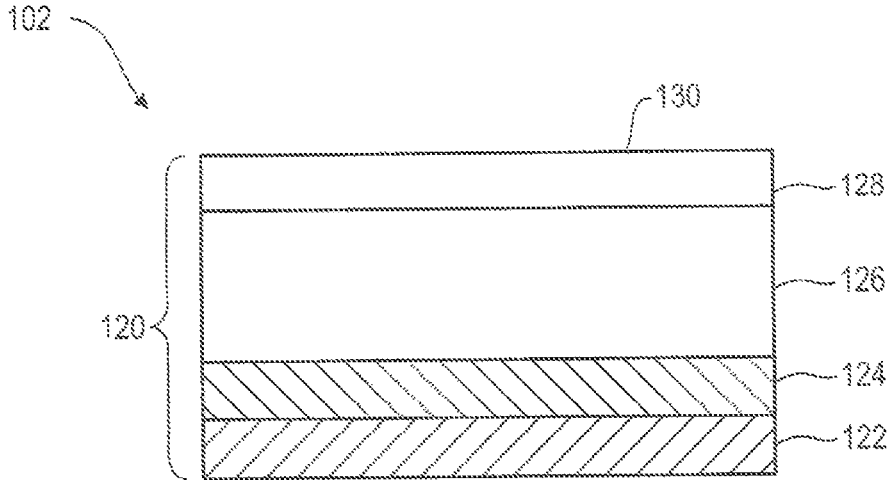
FIG. 1A is an enlargement of a portion of the OPC drum of FIG. 1.

FIG. 1A is an enlargement of a portion of the drum 102 of FIG. 1, and depicts an example configuration in accordance with the teachings herein. An OPC 120 may comprise a conductive substrate 122, a charge generation layer (CGL) 124, and a charge transport layer (CTL) 126. The thickness of the CTL 126 may be greater than 10 μm. A CTM-doped protective coating (DPC) 128 may be formed on the exterior surface of the CTL 126.

In essence, the organic photoconductor commonly used in electrophotographic applications is a dual layer structure consisting of a relatively thin (for example, 0.1 to 2 μm) bottom layer (CGL) and a relatively thick (for example, about 20 μm) top layer (CTL). Light passes through the transparent CTL and strikes the CGL that generates free electrons and holes. Electrons are collected by the electrical ground of the photoreceptor and holes are driven towards the top of the CTL by the applied electrical field. The CTL provides a mechanism for hole transport towards the surface, where they are used to neutralize negative surface ions deposited during the pre-charging process.

The CTL may consist of non-conductive organic material (usually a polymer) with charge transport moieties embedded in it. In most cases, the CTL may be made of a non-conductive polycarbonate matrix having charge transport moieties in form of conductive organic small molecules or short chain polymers, such as aryl hydrazones, aminoaryl heterocycles such as oxadiazole, and, in some examples, highly conjugated arylamines.

The organic photoreceptor (OPC) in an electrophotographic printer is a thin film photoconductive layer. An electrostatic latent image is formed on the pre-charged photoreceptor surface via image-wise optical exposure. A visual image is obtained after the electrostatic image is developed with charged color toner particles that are subsequently transferred to paper. After the toner is transferred to paper, the photoreceptor needs to be cleaned and the corona charged with ions to get ready for the next imaging process. In the electrophotographic process, the photoreceptor (web or cylinder) is required to have very uniform area characteristics: coating uniformity, dark conductivity, and photoconductivity. During each imaging cycle, the OPC surface is subjected to a number of punishing electrochemical and mechanical processes. They include corrosive ozone and acid treatments from corona charging, abrasive mechanical treatments from toner development, and toner transfer to paper and doctor blade cleaning. They may cause removal of the top part of CTL or mechanical damage (scratching) and local cracking of the CTL. In the case of liquid electrophotography (used in HP Indigo presses), these processes can be further enhanced by interactions between the solvent (usually a non-polar, ISOPAR®-based mixture) and the polymer constituting the CTL layer. Damage to the CTL can degrade print quality. Frequent photoconductor replacement has a deleterious impact on the cost of the printing process, which is particularly important for high speed/large volume printing applications (as in the case of HP Indigo presses).

The structure of the organic photoreceptor usually has several layers of materials, each of which performs a specific function, such as charge generation, charge transport, and occasionally additional surface protection. These layers are formed by individual sequential coatings. One of these layers is the charge transport material (CTM) layer, or CTL 126. In this regard, mainly aromatic tertiary amino compounds and their corresponding polymers are usually used. Generally, these materials are soluble in common organic solvents such as tetrahydrofuran (THF) and dichloromethane ($CH_2Cl_2$). Because of their solubility in these solvents, there is usually a loss of charge transport material and/or mixing with the material that is over-coated on top for protection. In addition, these materials cannot facilitate "fast" transport of electrical charges, making them less desirable for the high-speed printing applications, such as digital commercial printing.

In the electrophotographic process, the photoreceptor (belt or cylinder) ideally has very uniform area characteristics: coating uniformity, dark conductivity, and photoconductivity. During each imaging cycle, the OPC surface is subjected to a number of punishing electrochemical and mechanical processes. These include corrosive ozone and oxidative reactions from corona or charge roller charging, abrasive mechanical treatments from toner development, toner transfer to paper, and doctor blade cleaning of the drum and contact with a charge roller. The essential physical properties that dictate the electrophotographic imaging process, such as dark and photo conductivity and electronic defects on the photoreceptor surface etc. would definitely accelerate their deterioration under such detrimental conditions. Therefore, it is desirable to develop protective overcoats for the OPCs.

In the case of liquid electrophotography, these processes can be further enhanced by interactions between the solvent (usually a non-polar, isoparaffinic-based mixture) and the polymer constituting the CTL. In many cases, solvent can penetrate into the CTL through openings caused by the mechanically damaged surface and can cause local swelling of the CTL. The CTL damage degrades print quality, resulting in frequent replacement of the OPC. Mechanical damage of the OPC can be related to a relatively high concentration of the molecular conducting moieties (small molecules) that in some cases can be as high as 50% of the CTL volume. Frequent photoconductor replacement can have a negative impact on the cost of the printing process, which is particularly important for high speed/large volume printing applications, as in the case of digital commercial printers.

Previous attempts to improve the operational lifetime of the OPC surface region have relied on coating it with a layer of a "hard" inorganic film, such as carbon (e.g., graphite or diamond), silica, etc. This solution is not popular due to the following reasons: a) difficulties in forming such inorganic film on the organic substrate (lack of compatible deposition processes); b) excessively high cost of the inorganic films and their poor reliability; and c) "dust" issues due to the fact that the inorganic coating may "shed" microscopic particles caused by the mechanical interactions with the print engine components and poor adhesion of the inorganic coating to an organic substrate.

On the other hand, the promising results of using organic solvent-based cross-linkable coatings with CTMs to extend the lifetime of OPC have been demonstrated. Their advantage stems from the fact that, due to their superior electrical conductivity, the desired electrical properties of the coating can be achieved at low CTM concentrations without compromising mechanical strength of the layer. However, most of the CTMs can only be dissolved into more aggressive solvents such as toluene, xylenes, THF, chloroform, chlorobenzene, and dichlorobenzene, etc. Unfortunately, all of these solvents can damage the existing CTL 126 in a commercial OPC. Polycarbonates used in the CTL 126 can survive only a few solvents such as water and alcohols, while essentially all of the commercially-available CTMs have very poor solubility in water and alcohols. Thus, the development of water-soluble CTMs could permit a solution process to coat the OPC layer without damaging the polycarbonate layer.

More recent solutions have provided the charge transport layer of the OPC with a subsequently cross-linkable thin film that can significantly increase the OPC time-to-failure without degrading its printing performance. This improvement of the OPC lifetime is due to increased scratch resistance of the OPC coating as compared to scratch resistance of the original uncoated OPC.

These recent solutions include employing alcohol-soluble hole transport materials and coating the CTL 126 of the OPC with a solvent-based mixture containing monomer moieties which are cross-linked after deposition on the OPC. That is to say, the monomer is cross-linked in-situ on the surface of the OPC to provide the protective coating 128. This approach provides much better adhesion and higher mechanical strength layers than in the case where a previously cross-linked polymer is deposited on the OPC.

In accordance with the teachings herein, the foregoing challenges may be avoided by employing a latex polymer coating system with suitable charge transport materials (CTMs) that can be used for a water-based solution OPC coating process. The water-based solutions provide a more environmentally-friendly method for coating and are compatible with the polycarbonate surface of the existing OPC. The water-based latex polymer coating offers several advantages: (a) latex polymers have excellent film formation properties, (b) the film-based latex polymer has excellent chemical stability and is stable against a wide range of chemicals, (c) the film has excellent mechanical strength against scratches, and (d) the film has very strong water resistance.

Latex polymers refer to the polymeric masses synthesized from individual monomers, which can be dispersed in a water vehicle, forming a latex dispersion. They may be prepared thorough emulsion polymerization of a dispersion mixture of monomer, co-monomer, cross-linking agent, initiator, and surfactant. To the latex dispersion may be added a charge transport material, which may be dispersed therein. The entire dispersion mixture is then polymerized in-situ on the surface of the charge transport layer 126 to form a latex polymer overcoat layer 128.

Broadly speaking, the concentration ranges used in the dispersion mixture to form the latex polymer overcoat layer 128 may be as follows:

- 1 to 75 wt % cross-linkable monomer, oligomer, and/or polymer;
- 1 to 50 wt % cross-linking agent;
- 1 to 20 wt % initiator;
- 0 to 10 wt % surfactant;
- to 20 wt % charge transport material; and
- the balance water, in which up to one-half of the water is replaced by a water-soluble alcohol.

The total concentration of all components in the dispersion mixture is 100 wt %. The various components are described in greater detail below.

Generally, the functional glass transition temperature ($T_g$) of the latex copolymer can range from about 0° to 100° C. In one example, the functional $T_g$ can range from about 5° to 100° C. In another example, the $T_g$ can range from about 0° to 85° C. In yet another example, the $T_g$ can range from about 5° to 80° C.

As used herein, $T_g$ is the glass transition temperature of the latex copolymer as calculated by the Fox equation:

$$\frac{1}{T_g} = \frac{W_A}{T_{gA}} + \frac{W_B}{T_{gB}} + \dots ,$$

where $W_A$=weight fraction of monomer A in the copolymer and $T_{gA}$ is the homopolymer $T_g$ value of monomer A, $W_B$=weight fraction of monomer B and $T_{gB}$ is the homopolymer $T_g$ value of monomer B, etc.

Cross-Linkable Monomer, Oligomer, or Polymer

Specific latex particulates that can be used include those prepared using a monomer emulsion of various weight ratios of styrenes, C1 to C8 alkyl methacrylates, C1 to C8 alkyl acrylates, ethylene glycol methacrylates and dimethacrylates, methacrylic acids, acrylic acids, and the like, which can be copolymerized to form the latex. For example, methyl acrylate can be polymerized with acrylic acid. Though this latex particulate example is provided, other combinations of monomers can be used to form latex particulates.

The latex particulates described herein are generally polymerized from latex monomers as known in the art, or in the case of encapsulated pigments, include polymerized latex monomers. In one example, the monomer can include a linear aliphatic, branched aliphatic, or cyclic aliphatic acrylate. In another example, the encapsulated pigment and the latex particulate can include at least one hydrophilic monomer and one hydrophobic monomer. In one example, the linear aliphatic acrylate, branched aliphatic acrylate, or cyclic aliphatic acrylate can include, but is not limited to, ethyl, propyl, isobutyl, butyl, tert-arylbutyl, pentyl, hexyl, heptyl, octyl, nonyl, decyl, dodecyl, octadecyl, 2-ethylhexyl, lauryl, cyclohexyl, and butylcyclohexyl acrylates. Blends of these monomers with heteroatom containing functional monomers can also be used to enhance and fine tune a desire latex property. These monomers can include, but are not limited to, 2-hydroxylethyl acrylate, 2-hydroxylpropyl acrylate, 2-hydroxylbutyl acrylate, dimethylaminoethyl acrylate, glycidyl acrylate, butanediol acrylate, 2-carboxylethyl acrylate, 2-ethoxyethyl acrylate, di(ethylene glycol) methyl ether acrylate, ethylene glycol methyl ether acrylate, ethylene glycol phenyl ether acrylate, 2-(4-benzoyl-3-hydroxyphenoxy) ethyl acrylate, 2-(dialkylamino)ethyl acrylate, 2-(dialkylamino)propyl acrylate, 2-[[(butylamino)carbonyl]-oxy] ethyl acrylate, 2-hydroxyl-3-phenoxypropyl acrylate, 3,5,5-trimethylhexyl acrylate, 3-(trimethyloxysilyl)propyl acrylate, 3-sulfopropyl acrylate, di(ethylene glycol)-2-ethylhexyl ether acrylate, dipentaerythritol pentaacrylate, dipentaerythritol hexaacrylate, ethyl 2-(trimethylsilylmethyl) acrylate, alkylcyano acrylate, ethylene glycol dicyclopentenyl ether acrylate, acrylic acid, methacrylic acid, itaconic acid, fumaric acid, hydroxyethyl acrylate, hydroxylethyl methacrylate, acrylamide, methacrylamide, N-methylol (meth)acrylamide, acrylamidoacrylic acid, acrylamidoethyl (or propyl) methacrylate, 4-vinylpyridinium halide, and any monomer that contains urethane, amide, carbamate, carboxylate, carbonate, pyrimidone, urea, or isothiourea.

The hydrophobic monomer can be present in the polymer from up to 98 wt %, e.g., in one example, from 50 wt % to 98 wt %. Hydrophobic monomers that can be polymerized to form the latex particulate can include, without limitation, styrene, p-methyl styrene, methyl methacrylate, hexyl acrylate, hexyl methacrylate, butyl acrylate, butyl methacrylate, ethyl acrylate, ethyl methacrylate, propyl acrylate, propyl methacrylate, octadecyl acrylate, octadecyl methacrylate, stearyl methacrylate, vinylbenzyl chloride, isobornyl acrylate, tetrahydrofurfuryl acrylate, 2-phenoxyethyl methacrylate, ethoxylated nonyl phenol methacrylate, isobornyl methacrylate, cyclohexyl methacrylate, t-butyl methacrylate, n-octyl methacrylate, lauryl methacrylate, trydecyl methacrylate, alkoxylated tetrahydrofurfuryl acrylate, isodecyl acrylate, or isobornylmethacrylate, combinations thereof, derivatives thereof, and mixtures thereof.

Hydrophilic monomers can include, without limitation, acrylic acid, methacrylic acid, ethacrylic acid, dimethylacrylic acid, maleic anhydride, succinic anhydride, vinylsulfonate, cyanoacrylic acid, methylenemalonic acid, vinylacetic acid, allylacetic acid, ethylidineacetic acid, propylidineacetic acid, crotonoic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, aconitic acid, phenylacrylic acid, acryloxypropionic acid, vinylbenzoic acid, N-vinylsuccinamidic acid, mesaconic acid, methacroylalanine, acryloylhydroxyglycine, sulfoethyl methacrylic acid, sulfopropyl acrylic acid, sulfonic acid, styrene sulfonic acid, sulfoethylacrylic acid, 2-methacryloyloxymethane-1-sulfonic acid, 3-methacryoyloxypropane-1-sulfonic acid, 3-(vinyloxy)propane-1-sulfonic acid, ethylenesulfonic acid, vinyl sulfuric acid, 4-vinylphenyl sulfuric acid, ethylene phosphonic acid, vinyl phosphoric acid, vinyl benzoic acid, 2-acrylamido-2-methyl-1-propanesulfonic acid, 3-sulfopropyl methacrylate, copolymers of polyethylene glycols, poly(ethylene glycol), poly(propylene glycol), copolymers of ethylene glycol, copolymers of propylene glycol, formamides, N-vinyl formamide, acrylamide, methacrylamide, N-vinyl pyrrolidone, water-soluble hydroxy-substituted acrylic or methacrylic esters, hydroxy ethylacrylate, 2-hydroxyethyl methacrylate, methoxypolyethylene glycol methacrylate, ethyltriethyleneglycol methacrylate, acrylamides, and mixtures thereof. In another example, the hydrophilic monomer can be an acidic monomer. As such, the acidic monomer can be selected from the group consisting of acrylic acid, methacrylic acid, ethacrylic acid, dimethylacrylic acid, maleic anhydride, succinic anhydride, vinylsulfonate, cyanoacrylic acid, methylenemalonic acid, vinylacetic acid, allylacetic acid, ethylidineacetic acid, propylidineacetic acid, crotonoic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, aconitic acid, phenylacrylic acid, acryloxypropionic acid, vinylbenzoic acid, N-vinylsuccinamidic acid, mesaconic acid, methacroylalanine, acryloylhydroxyglycine, sulfoethyl methacrylic acid, sulfopropyl acrylic acid, sulfonic acid, styrene sulfonic acid, sulfoethylacrylic acid, 2-methacryloyloxymethane-1-sulfonic acid, 3-methacryoyloxypropane-1-sulfonic acid, 3-(vinyloxy)propane-1-sulfonic acid, ethylenesulfonic acid, vinyl sulfuric acid, 4-vinylphenyl sulfuric acid, ethylene phosphonic acid, vinyl phosphonic acid, vinyl benzoic acid, or 2-acrylamido-2-methyl-1-propanesulfonic acid, combinations thereof, and derivatives thereof.

Acidic monomers can be present in the polymer from about 0.1 wt % to about 30 wt. Acidic monomers that can be used in the polymer include, without limitation, acrylic acid, methacrylic acid, ethacrylic acid, dimethylacrylic acid, maleic anhydride, maleic acid, vinylsulfonate, cyanoacrylic acid, vinylacetic acid, allylacetic acid, ethylidineacetic acid, propylidineacetic acid, crotonoic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, aconitic acid, phenylacrylic acid, acryloxypropionic acid, vinylbenzoic acid, N-vinylsuccinamidic acid, mesaconic acid, methacroylalanine, acryloylhydroxyglycine, sulfoethyl methacrylic acid, sulfopropyl acrylic acid, styrene sulfonic acid, sulfoethylacrylic acid, 2-methacryloyloxymethane-1-sulfonic acid, 3-methacryoyloxypropane-1-sulfonic acid, 3-(vinyloxy)propane-1-sulfonic acid, ethylenesulfonic acid, vinyl sulfuric acid, 4-vinylphenyl sulfuric acid, ethylene phosphonic acid, vinyl phosphoric acid, vinyl benzoic acid, 2-acrylamido-2-methyl-1-propanesulfonic acid, combinations thereof, derivatives thereof, and mixtures thereof.

Cross-Linking Agent

Examples of polyfunctional cross-linking agents, by way of illustration and not limitation, include multifunctional acrylates such as diacrylates, triacrylates, tetraacrylates, and the like. In some examples, the multifunctional acrylates may include a portion or moiety that functions as a polymer precursor as described herein below. Examples of multifunctional acrylate monomers or oligomers that may be employed as the polyfunctional cross-linking agent (some of which include a polymer precursor moiety) in the present examples, by way of illustration and not limitation, include diacrylates such as propoxylated neopentyl glycol diacrylate (available from Atofina Chemicals, Inc., Philadelphia Pa., as Sartomer SR 9003), 1,6-hexanediol diacrylate (Sartomer SR 238 from Sartomer Company, Inc., Exton Pa.), tripropylene glycol diacrylate, dipropylene glycol diacrylate, aliphatic diacrylate oligomer (CN 132 from Atofina), aliphatic urethane diacrylate (CN 981 from Atofina), and aromatic urethane diacrylate (CN 976 from Atofina), triacrylates or higher functionality monomers or oligomers such as amine modified polyether acrylates (available as PO 83 F, LR 8869, or LR 8889 from BASF Corporation), trimethylol propane triacrylate: (Sartomer SR 351), tris(2-hydroxy ethyl) isocyanurate triacrylate (Sartomer SR 368), aromatic urethane triacrylate (CN 970 from Atofina), dipentaerythritol penta-/hexa-acrylate, pentaerythritol tetraacrylate (Sartomer SR 295), ethoxylated pentaerythritol tetraacrylate (Sartomer SR 494), and dipentaerythritol pentaacrylate (Sartomer SR 399), or mixtures of any of the foregoing. Additional examples of suitable cross-linking additives include chlorinated polyester acrylate (Sartomer CN 2100), amine modified epoxy acrylate (Sartomer CN 2100), aromatic urethane acrylate (Sartomer CN 2901), and polyurethane acrylate (Laromer LR 8949 from BASF). Other examples of polyfunctional cross-linking agents include, for example, end-capped acrylate moieties present on such oligomers as epoxy-acrylates, polyester-acrylates, acrylate oligomers, polyether acrylates, polyether-urethane acrylates, polyester-urethane acrylates, and polyurethanes end-capped with acrylate moieties such as hydroxyethyl acrylate. Further, the polyurethane oligomer can be prepared utilizing an aliphatic diisocyanate such as hexamethylene diisocyanate, cyclohexane diisocyanate, diisocyclohexylmethane diisocyanate, isophorone diisocyanate, for example. Other examples include isophorone diisocyanate, polyester polyurethane prepared from adipic acid and neopentyl glycol, for example. Specific examples of polyfunctional cross-linking agents that include isocyanate functionalities and acrylate functionalities include materials sold by Sartomer Company such as, for example, CN966-H90, CN964, CN966, CN981, CN982, CN986, Pro1154 and CN301.

Initiator

Generally, the dispersion mixture will include an initiator, usually a thermal initiator. The initiator may be present in the dispersion mixture in a concentration range of about 1 to 20 wt %.

Examples of suitable thermal initiators include organic peroxides, azo compounds and inorganic peroxides. Illustrative examples of organic peroxides include diacyl peroxide, peroxycarbonate, and peroxyester, as well as azobisisobutyronitrile, and azobis(cyclohexane-carbonitrile). In some examples, the organic peroxide may be a radical initiator such as isobutyl peroxide, benzoyl peroxide, lauroyl peroxide, stearyl peroxide, succinic acid peroxide, di-n-propyl peroxydicarbonate, diisopropyl peroxydicarbonate, or bis(4-tertbutylcyclohexyl)peroxy-dicarbonate. Examples of the inorganic initiators may include ammonium persulfate, sodium persulfate, and potassium persulfate. Combinations of two or more of the above may also be employed.

Surfactant

One or more non-ionic, cationic, and/or anionic surfactant(s) can also be present, and if present, can be included at from about 0.01 to 10 wt %.

In some examples, the surfactant may contain hydrophilic groups that allow the latex particulates and charge transport material to be better dispersed and/or stabilized in an aqueous medium. The hydrophilic groups can be anionic, cationic, nonionic, or zwitterionic. For example, suitable anionic groups include sulfonate, phosphonate, and carboxylate groups; suitable cationic groups include amine groups; and suitable nonionic groups include polyethelyene oxide, imidazole and amido groups. As such, in one example, the reactive surfactants can be functionalized ethylene glycol acrylates, including the SIPOMER® series of surfactants from Rhodia. Other non-limiting examples of reactive surfactants include HITENOL™ (polyoxyethylene alkylphenyl ether ammonium sulfate) and NOIGEN™ (polyoxyethylene alkylphenyl ether) reactive surfactants commercially available from Dai-Ichi Kogyo Seiyaku Co., Ltd. of Japan; TREM® (sulfosuccinates) commercially available from Henkel; and the MAXEMUL® (anionic phosphate ester) reactive surfactants commercially available from Uniqema of the Netherlands. Suitable grades of some of the materials listed above may include HITENOL BC-20, NOIZEN RN-30, TREM LT-40, and MAXEMUL 6106 and 61 12. One or more of many surfactants can also be used as are known by those skilled in the art of ink formulation and may be alkyl polyethylene oxides, alkyl phenyl polyethylene oxides, polyethylene oxide block copolymers, acetylenic polyethylene oxides, polyethylene oxide (di)esters, polyethylene oxide amines, protonated polyethylene oxide amines, protonated polyethylene oxide amides, dimethicone copolyols, substituted amine oxides, and the like.

Solvent

In each of the above examples, typical liquid vehicle formulations that can be used with the latex particulates, and methods of the present invention may include water as the solvent and one or more co-solvents as the balance, typically an amount from about 5 to 50 wt %. If a co-solvent is employed, up to one-half of the water may be replaced by a water-soluble alcohol, such as methanol, ethanol, propanol, or butanol to form a water-based solvent.

Alternative Approach

Another approach is to use a pre-formed latex polymer for the overcoat layer 128. For example, commercially-available latex polymers may also be used in the OPC coating process. The following examples are commercially available latex polymers from Specialty Polymers, Inc. (Woodbum, Oreg. 97071), including SC 29706 RayCryl-30S, RayCryl-1856, RayCryl-61, RayCryl-1859, RayCryl-347, RayCryl-2007, RayCryl-351C, RayCryl-4100, RayCryl-410, RayCryl-4102, RayCryl-412, RayCryl-4155L, RayCryl-604A, RayCryl-708E, RayCryl-7181, RayCryl-767, RayCryl-775, RayCryl-1001, RayCryl-1020, RayCryl-1200, RayCryl-1240, RayCryl-1500, RayCryl-1526, RayCryl-1809, RayCryl-1850, RayCryl-1853, RayFlex-118, RayFlex-164, RayFlex-303, RayFlex-610, RayFlex-613, RayFlex-683, RayFlex-765, RayFlex-2024, RayKote-444S, RayKote-970, RayKote-1431, RayKote-1515, RayKote-1610, RayKote-2000, RayKote-2001, RayRez-66, RayRez-117, RayRez-145, RayRez-165, RayRez-168A, RayRez-169, RayRez-182A, RayRez-182D, RayRez-200, RayRez-254, RayRez-256, RayTech-49, RayTech-51, RayTech-1175, RayVace-331, RayVace-674, RayVace-678, RayVace-1724

In this example, the concentration ranges used in the dispersion mixture to form the latex polymer overcoat layer 128 may be as follows:

1 to 75 wt % pre-formed latex polymer;

0.01 to 10 wt % surfactant;

0.1 to 20 wt % charge transport material; and the balance water, in which up to one-half of the water is replaced by a water-soluble alcohol.

Charge Transport Material

Turning now to water-soluble charge transport materials (CTMs) based on the foregoing discussion, technically, any water-soluble CTMs, or dopants, can be used for the OPC coating 128. The hole transport polymers or oligomers contained in the formulation can be, but are not limited to, semiconducting conjugated polymers, and may have, but are not limited to, a chemical structure as shown in Scheme 1:

Scheme 1

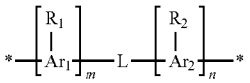

wherein, $Ar_1$ and $Ar_2$ are each independently aromatic ring moieties;

$R_1$ and $R_2$ are each independently selected from the group consisting of C1-C30 alkyl, C1-C30 alkenyl, C1-C30 alkynyl, C1-C30 aryl, C1-C30 alkoxy, C1-C30 phenoxy, C1-C30 thioalkyl, C1-C30 thioaryl, C(O)OR4, $N(R_4)(R_5)$, $C(O)N(R_4)(R_5)$, F, Cl, Br, $NO_2$, CN, acyl, carboxylate and hydroxy, wherein $R_4$ and $R_5$ are each independently selected from hydrogen and C1-C30 alkyl;

L is a linker that connects the two aromatic rings; in this case, it can be either nitrogen or a single bond;

the letters m and n are integers independently between 0 and about 5,000 with the proviso that at least one of m or n is not 0.

The phrase "aromatic ring moiety" or "aromatic" as used herein includes monocyclic rings, bicyclic ring systems, and polycyclic ring systems, in which the monocyclic ring, or at least a portion of the bicyclic ring system or polycyclic ring system, is aromatic (exhibits, e.g., π-conjugation). The monocyclic rings, bicyclic ring systems, and polycyclic ring systems of the aromatic ring moiety may include carbocyclic rings and/or heterocyclic rings. The term "carbocyclic ring" denotes a ring in which each ring atom is carbon. The term "heterocyclic ring" denotes a ring in which at least one ring atom is not carbon and comprises 1 to 4 heteroatoms.

By way of example and not limitation, each of $Ar_1$ and $Ar_2$ may be independently selected from phenyl, fluorenyl, biphenyl, terphenyl, tetraphenyl, naphthyl, anthryl, pyrenyl, phenanthryl, thiophenyl, pyrrolyl, furanyl, imidazolyl, triazolyl, isoxazolyl, oxazolyl, oxadiazolyl, furazanyl, pyridyl, bipyridyl, pyridazinyl, pyrimidyl, pyrazinyl, triazinyl, tetrazinyl, benzofuranyl, benzothiophenyl, indolyl, isoindazolyl, benzimidazolyl, benzotriazolyl, benzoxazolyl, quinolyl, isoquinolyl, cinnolyl, quinazolyl, naphthyridyl, phthalazyl, phentriazyl, benzotetrazyl, carbazolyl, dibenzofuranyl, dibenzothiophenyl, acridyl, and phenazyl. Suitable polar functional groups such as ammonium salts, suffonic acid salt, carboxylic acid salts can be introduced to make those CTMs water-soluble. Alternatively, any of the polyethylene glycols (PEG) may be introduced onto the molecule to make the CTM water-soluble.

Fabrication Procedure

Figure 2:
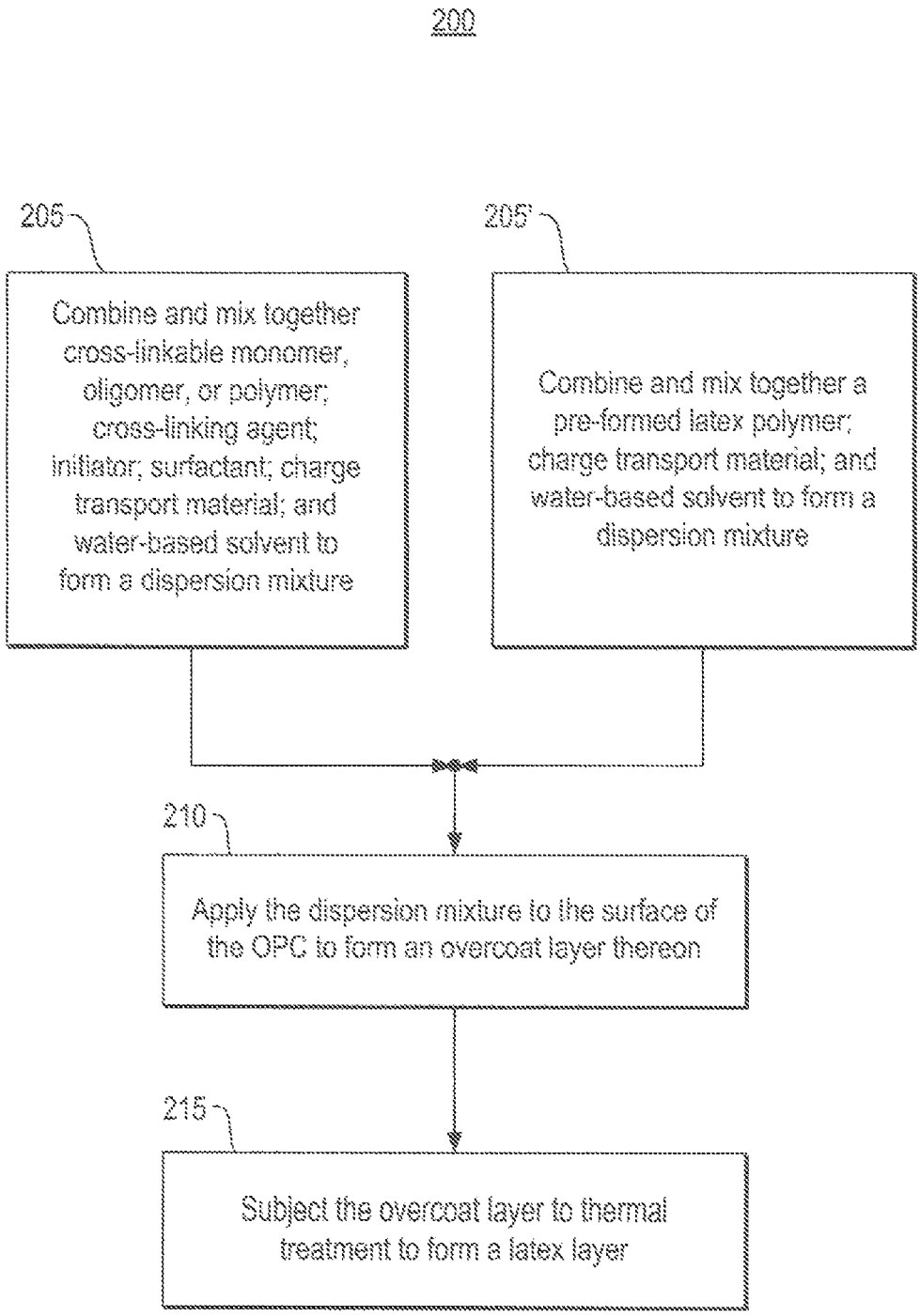
FIG. 2 depicts two example processes for forming an overcoat layer on the OPC.

FIG. 2 depicts an example process 200 for the fabrication of the OPC overcoat 128, with charge transport material containing latex polymer formulations.

In the first approach, the components described above are combined and mixed together 205, such as by mechanical shaking or room temperature sonication, to form a dispersion mixture. Then, the resulting dispersion mixture is applied 210 to the surface of the OPC 124, such as by spin-coating, roll-coating, dip coating, spray coating, roll-to-roll coating, or printing methods, or other such methods. Spin-coating removes most of the solvent (water plus co-solvent, if any), leaving a film. The entire assembly is subjected 215 to thermal treatment, such as by placement in an oven, to polymerize and form the latex polymer in-situ. Typically, the temperature employed may be in the range of about 50° to 100° C., and in some examples, about 80° C. The time of heating may range from may be in the range of about 1 to 10 hours, with the shorter times often associated with the higher temperatures. Routine experimentation may be used to develop an optimum set of heat treating conditions. The thickness of the latex overcoat layer may be in the range of about 0.05 to 5 μm.

In the alternative approach of using pre-formed latex polymers, the process for forming the latex overcoating 128 involves combining and mixing together 205' a charge transport material and a surfactant with a pre-formed latex polymer in a water-based solvent to form a dispersion mixture. The charge transport material, the surfactant, and the water-based solvent each may be as described above. Next, the dispersion mixture is applied 210 to the surface of the OPC 124 as above. Finally, the entire assembly is subjected 215 to thermal treatment, also as described above, to form a latex overcoat 128 on the OPC. Again, the thickness of the latex overcoat layer may be in the range of about 0.05 to 5 μm.

What is claimed is:

1. An organic photoconductor including: a conductive substrate; a charge generation layer on the conductive substrate; a charge transport layer on the charge generation layer; and an overcoat layer on the charge transport layer comprising a latex polymer in which a charge transport material is dispersed.

2. The organic photoconductor of claim 1 wherein the overcoat layer is formed from a dispersion comprising a cross-linkable monomer, oligomer or polymer, a cross-linking agent, an initiator, the charge transport material, and a water-based solvent.

3. The organic photoconductor of claim 2 wherein the dispersion further includes a surfactant.

4. The organic photoconductor of claim 3 wherein the overcoat layer comprises:

1 to 75 wt % cross-linkable monomer, oligomer, or polymer;

1 to 50 wt % cross-linking agent;

1 to 20 wt % initiator;

0 to 10 wt % surfactant;

0.1 to 20 wt % charge transport material; and the balance water, in which from 0 to 50% of the water is replaced by a water- soluble alcohol.

5. The organic photoconductor of claim 1 wherein the charge transport material comprises:

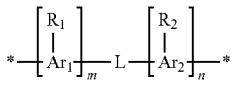

wherein, $Ar_1$ and $Ar_2$ are each independently aromatic ring moieties;

$R_1$ and $R_2$ are each independently selected from the group consisting of C1-C30 alkyl, C1-C30 alkenyl, C1-C30 alkynyl, C1-C30 aryl, C1-C30 alkoxy, C1-C30 phenoxy, C1-C30 thioalkyl, C1-C30 thioaryl, $C(O)OR_4$, $N(R_4)(R_5)$, $C(O)N(R_4)(R_5)$, F, Cl, Br, $NO_2$, CN, acyl, carboxylate and hydroxy, wherein $R_4$ and $R_5$ are each independently selected from hydrogen and C1-C30 alkyl;

L is a linker that connects the two aromatic rings; and the letters m and n are integers independently between 0 and about 5,000 with the proviso that at least one of m or n is not 0.

6. The organic photoconductor of claim 5 wherein $Ar_1$ and $Ar_2$ are independently selected from the group consisting of phenyl, fluorenyl, biphenyl, terphenyl, tetraphenyl, naphthyl, anthryl, pyrenyl, phenanthryl, thiophenyl, pyrrolyl, furanyl, imidazolyl, triazolyl, isoxazolyl, oxazolyl, oxadiazolyl, furazanyl, pyridyl, bipyridyl, pyridazinyl, pyrimidyl, pyrazinyl, triazinyl, tetrazinyl, benzofuranyl, benzothiophenyl, indolyl, isoindazolyl, benzimidazolyl, benzotriazolyl, benzoxazolyl, quinolyl, isoquinolyl, cinnolyl, quinazolyl, naphthyridyl, phthalazyl, phentriazyl, benzotetrazyl, carbazolyl, dibenzofuranyl, dibenzothiophenyl, acridyl, and phenazyl.

7. The organic photoconductor of claim 5 wherein L is either nitrogen or a single bond.

8. A process for forming a protective coating on an organic photoconductor comprising an inner charge generation layer for generating charges and an outer charge transport layer on the charge generation layer, the charge transport layer for facilitating charge movement, the process including:

combining and mixing together charge transport materials with a cross-linkable formulation that includes a cross-linkable monomer, oligomer, or polymer; a cross-linking agent, and an initiator, in a water-based solvent to form a dispersion mixture;

applying the dispersion mixture to the surface of the organic photoconductor to form an overcoat layer thereon; and subjecting the overcoat layer to thermal treatment to form a latex layer.

9. The process of claim 8 wherein the following components are mixed in the concentrations given to form the solution:

1 to 75 wt % cross-linkable monomer, oligomer, or polymer;

1 to 50 wt % cross-linking agent;

1 to 20 wt % initiator;

0 to 10 wt % surfactant;

0.1 to 20 wt % charge transport material; and the balance water, in which from 0 to 50% of the water is replaced by a water-soluble alcohol.

10. The process of claim 8 wherein the cross-linkable monomer, oligomer, or polymer is selected from the group consisting of styrenes, C1 to C8 alkyl methacrylates, C1 to C8 alkyl acrylates, ethylene glycol methacrylates, ethylene glycol dimethacrylates, methacrylic acids, and acrylic acids.

11. The process of claim 8 wherein the cross-linking agent is a multifunctional acrylate selected from the group consisting of diacrylates, triacrylates, and tetraacrylates.

12. The process of claim 8 wherein the initiator is selected from the group consisting of organic peroxides, azo compounds and inorganic peroxides.

13. The process of claim 8 wherein the surfactant, if present, is selected from the group consisting of non-ionic, cationic, and anionic surfactants.

14. The process of claim 8 wherein the charge transport material comprises:

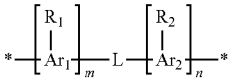

wherein, $Ar_1$ and $Ar_2$ are each independently aromatic ring moieties;

$R_1$ and $R_2$ are each independently selected from the group consisting of C1-C30 alkyl, C1-C30 alkenyl, C1-C30 alkynyl, C1-C30 aryl, C1-C30 alkoxy, C1-C30 phenoxy, C1-C30 thioalkyl, C1-C30 thioaryl, $C(O)OR_4$, $N(R_4)(R_5)$, $C(O)N(R_4)(R_5)$, F, Cl, Br, $NO_2$, CN, acyl, carboxylate and hydroxy, wherein $R_4$ and $R_5$ are each independently selected from hydrogen and C1-C30 alkyl;

L is a linker that connects the two aromatic rings; and the letters m and n are integers independently between 0 and about 5,000 with the proviso that at least one of m or n is not 0.

15. The process of claim 8 wherein up to 50% of the water is replaced by a water-soluble alcohol.

16. The process of claim 8 wherein the mixture is applied to the charge generation layer by any of spin-coating, roll-coating, dip coating, spray coating, roll-to-roll coating, or printing methods.

17. The process of claim 8 wherein the mixture on the charge transport layer is polymerized by exposure to an elevated temperature in a range of about 50° to 100° C. and for a period of time in a range of about 1 to 10 hours.

18. A process for forming a protective coating on an organic photoconductor comprising an inner charge generation layer for generating charges and an outer charge transport layer on the charge generation layer, the charge transport layer for facilitating charge movement, the process including:

combining and mixing together a charge transport material and a surfactant with a pre-formed latex polymer in a water-based solvent to form a dispersion mixture;

applying the dispersion mixture to the surface of the organic photoconductor to form an overcoat layer thereon; and subjecting the overcoat layer to thermal treatment to form a latex layer.

19. The process of claim 18 wherein the thermal treatment is carried out at elevated temperature in a range of about 50° to 100° C. for a period of time in a range of about 1 to 10 hours.

20. The process of claim 18 wherein the following components are mixed in the concentrations given to form the solution:

1 to 75 wt % pre-formed latex polymer;

0.01 to 10 wt % surfactant;

0.1 to 20 wt % charge transport material; and the balance water, in which from 0 to 50% of the water is replaced by a water-soluble alcohol.

* * * * *

UNITED STATES PATENT AND TRADEMARK OFFICE

CERTIFICATE OF CORRECTION

PATENT NO. : 8,841,053 B2
APPLICATION NO. : 13/552940
DATED : September 23, 2014
INVENTOR(S) : Zhang-Lin Zhou et al.

It is certified that error appears in the above-identified patent and that said Letters Patent is hereby corrected as shown below:

In the Claims

In column 12, line 33, in Claim 4, delete "water- soluble" and insert -- water-soluble --, therefor.

Signed and Sealed this
Twenty-seventh Day of January, 2015

Michelle K. Lee

Michelle K. Lee
*Deputy Director of the United States Patent and Trademark Office*